US010407893B2

(12) United States Patent
Marcaccioli

(10) Patent No.: US 10,407,893 B2
(45) Date of Patent: Sep. 10, 2019

(54) BUILDING SYSTEM FOR A MULTI-STORY BUILDING AND METHOD

(71) Applicant: Gruppo Piccini S.P.A., Milan (IT)

(72) Inventor: Luciano Marcaccioli, Perugia (IT)

(73) Assignee: Gruppo Piccini S.P.A., Milan (IT)

( * ) Notice: Subject to any disclaimer, the term of this patent is extended or adjusted under 35 U.S.C. 154(b) by 9 days.

(21) Appl. No.: 15/516,630

(22) PCT Filed: Oct. 2, 2015

(86) PCT No.: PCT/IB2015/057555
§ 371 (c)(1),
(2) Date: Apr. 3, 2017

(87) PCT Pub. No.: WO2016/051387
PCT Pub. Date: Apr. 7, 2016

(65) Prior Publication Data

US 2018/0266098 A1 Sep. 20, 2018

(30) Foreign Application Priority Data

Oct. 2, 2014 (IT) ..... RM2014A0564

(51) Int. Cl.
*E04B 1/18* (2006.01)
*E04B 1/20* (2006.01)
(Continued)

(52) U.S. Cl.
CPC ..... *E04B 1/215* (2013.01); *E04B 1/20* (2013.01); *E04B 5/04* (2013.01); *E04B 5/043* (2013.01);
(Continued)

(58) Field of Classification Search
CPC ... E04B 1/04; E04B 1/043; E04B 1/06; E04B 1/16; E04B 1/161; E04B 1/165;
(Continued)

(56) References Cited

U.S. PATENT DOCUMENTS 1,380,324 A * 5/1921 Piggins ..... E04B 1/215 52/236.7
3,562,979 A * 2/1971 Ali-Oglu ..... E04B 1/215 52/125.5
(Continued)

FOREIGN PATENT DOCUMENTS

| | | |
|---|---|---|
| DE | 2051002 A1 | 4/1972 |
| FR | 1157412 A | 5/1958 |
| NL | 7101456 A | 6/1972 |

OTHER PUBLICATIONS

BFT International; "Fip-Handbuch Fur Planung Und Entwurf Von Fertigteilbauten/Fip-Planning and Design Handbook on Precast Building Structures"; Jun. 1996; p. 116-134; vol. 62, No. 6.

*Primary Examiner* — Phi D A
(74) *Attorney, Agent, or Firm* — Stetina Brunda Garred & Brucker

(57) ABSTRACT

A building system for buildings comprising at least two stories, provided with: —a plurality of first portals (3, 3') adapted to be arranged along at least two mutually parallel vertical planes and to be fixed to a base (2); —first connecting beams (15) for connecting a first portal (3') and the next first portal (3) arranged along a same vertical plane of said at least two vertical planes; first floor panels (17) adapted to transversely connect together both the first portals (3, 3') arranged along the at least two vertical planes, and the first connecting beams (15) arranged along the at least two vertical planes; —a plurality of second portals (40, 40') adapted to be arranged along said at least two vertical planes, each on top of a respective first portal (3, 3'); wherein each first portal (3, 3') and each second portal (40, 40') are monolithic and substantially consist of at least two pillars (4) parallel to each other and of a beam (5, 5'), arranged transversely on top of the pillars (4), each pillar (4) being provided with a plurality of first connecting bars (9), which
(Continued)

are arranged inside each pillar (4), parallel to the longitudinal axis thereof, and extend outwards above the beam (5, 5'), and wherein a plurality of anchoring plates (11) is included, each anchoring plate being provided with through holes and constrained to the lower end (7) of a respective pillar, whereby the first connecting bars of the first portals are adapted to be inserted and clamped by clamping means (13) into the through holes of the anchoring plate of the respective second portals.

12 Claims, 10 Drawing Sheets

(51) Int. Cl.

| | |
|---|---|
| ***E04C 3/20*** | (2006.01) |
| ***E04C 3/30*** | (2006.01) |
| ***E04B 1/21*** | (2006.01) |
| ***E04B 5/04*** | (2006.01) |
| ***E04C 3/293*** | (2006.01) |
| ***E04C 3/294*** | (2006.01) |
| *E04B 1/30* | (2006.01) |

(52) U.S. Cl.
CPC ..... *E04C 3/293* (2013.01); *E04C 3/294* (2013.01); *E04B 1/18* (2013.01); *E04B 1/30* (2013.01); *E04C 3/20* (2013.01)

(58) Field of Classification Search
CPC ..... E04B 1/18; E04B 1/19; E04B 1/20; E04B 1/21; E04B 1/30; E04B 1/215; E04C 1/24; E04C 3/20; E04C 3/3205; E04C 3/293; E04C 3/294; E04C 3/30; E04C 3/34
See application file for complete search history.

(56) References Cited

U.S. PATENT DOCUMENTS 3,613,325 A 10/1971 Yee
3,645,056 A * 2/1972 Gerola ..... E04B 1/043 52/259
5,161,340 A * 11/1992 Wetton ..... E04B 1/21 52/236.7
7,171,787 B2 * 2/2007 Thomason ..... E04H 4/0087 52/169.7

* cited by examiner

BUILDING SYSTEM FOR A MULTI-STORY BUILDING AND METHOD

CROSS REFERENCE TO RELATED APPLICATIONS

The present application claims priority to PCT International Application No. PCT/IB2015/05755 filed on Oct. 2, 2015, which application claims priority to Italian Patent Application No. RM2014A000564 filed Oct. 2, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a building system for multi-story building using prefabricated elements.

BACKGROUND ART

Prefabricated concrete elements of various types are commonly used in building for the construction of various types of buildings, especially multi-story buildings, such as residential buildings, schools, hospitals, offices and hotels. In this type of technology, a frame is generally assembled on the construction site, consisting of prefabricated concrete elements, such as pillars, beams and floors, having a substantially linear geometry. Such prefabricated elements are produced in special production sites quicker than when they are produced at the final construction site. The assembly of the prefabricated elements generally includes the steps of positioning and then joining them by wet connections or by welding metal inserts, so as to obtain sufficient stiffness of the panel points between the elements, further requiring appropriate shoring.

Disadvantageously, the assembly of such traditional prefabricated elements is particularly long and impractical, typically including, for each building story, the steps of:

- assembling and shoring the vertical elements (columns, pillars);
- assembling and shoring the horizontal elements (beams);
- assembling and shoring the floor elements;
- implementing the connections using additional casting and armors;
- waiting for the partial or complete curing of the additional casting;
- disassembling and recovering the props, following an adequate curing of the concrete of the panel points or of the full sections of the structural elements.

Thereafter, the assembly operations continue as a function of the desired number of building stories through a new cycle of vertical progress.

Disadvantageously, all of these operations require quite long times, especially if compared with the high production speed of the elements which are prefabricated in factories, made ad hoc, therefore they hold back a progress of the works which could be much faster.

The number of pieces to be mounted, the operations needed to ensure a condition of sufficient static and adjustment stability of the vertical and horizontal levels also require long times.

In addition, disadvantageously, a large, highly qualified staff is required for the assembly of such structures.

A further drawback associated with traditional prefabricated concrete elements is that the above assembly operations can be strongly influenced by the different climatic zones where the assembly is carried out, such as: zones with strong solar radiation and high temperatures, such as the Middle East, desert areas, etc.; or areas with high rainfall, particularly with strong rains, such as the areas of the Equatorial belt; or areas with very cold climates, where temperatures are often below 0° C., as in the zones of the North, Russia, Scandinavia, etc.

In order to operate properly in these climates, the assembly time on-site should be reduced as much as possible, such as trying to make the largest possible number of operations at production factories other than the building yard where the prefabricated elements are assembled.

U.S. Pat. No. 3,613,325 describes a system in which only two prefabricated components are provided: floor panels and structural units consisting of a horizontal beam placed between one or more upper columns and one or more lower columns. Disadvantageously, such structural units are laterally connected to one another through concrete castings made on site, for which the construction times are still long and shoring and formworks are needed, since the system is not self-supporting in all the building steps. The mode of vertically connecting the structural units also leaves room for improvement. In fact, in order to connect a lower structural unit to an upper structural unit, an expansion mortar must be cast in the sleeves which house the connecting bars. Shoring is also required during this operation since the connection between connecting bars and sleeves is not stable without applying the mortar.

In summary, for the construction of buildings, particularly multi-story buildings, with construction techniques using prefabricated concrete elements, an important step which requires long times and particular attention to details, resulting in a high probability of making mistakes, and which is strongly influenced by climatic factors, is the assembly of such prefabricated elements at the construction site.

The need to implement a building system for multi-story buildings allowing said drawbacks to be overcome is therefore felt.

SUMMARY OF THE INVENTION

It is an object of the present invention to provide a building system for a multi-story building which allows the above drawbacks to be overcome.

It is a further object of the present invention to provide a building system which is self-supporting in all the building steps, so that shoring is not required.

It is another object of the invention to provide a process for building a multi-story building using the system of the invention.

The present invention therefore aims to achieve the objects discussed above by providing a building system comprising at least two stories, the system using prefabricated reinforced concrete components and, according to claim 1, comprising:

- a plurality of first portals adapted to be arranged along at least two mutually parallel vertical planes and to be fixed to a base;
- first connecting beams for connecting a first portal and the next first portal arranged along a same vertical plane of said at least two vertical planes;

first floor panels adapted to transversely connect together both the first portals arranged along the at least two vertical planes, and the first connecting beams arranged along the at least two vertical planes;

a plurality of second portals adapted to be arranged along said at least two vertical planes, each on top of a respective first portal;

wherein each first portal and each second portal are monolithic and consist of at least two pillars parallel to each other and of a beam, arranged transversely and completely on top of the pillars, each pillar being provided with a plurality of first connecting bars, which are arranged inside each pillar, parallel to the longitudinal axis thereof, and extend outwards above the beam, wherein there is provided a plurality of anchoring plates, each anchoring plate being provided with through holes and constrained to a lower end of a respective pillar;

and wherein each pillar is provided at the lower end thereof with a plurality of notches which provide each an empty space, delimited at the bottom by the respective anchoring plate, whereby the first connecting bars of the first portals are adapted to be inserted and clamped by clamping means into the through holes of the anchoring plate of the respective second portals and clamped in said empty space by clamping means.

In a preferred variant, the pillars of each portal are only two.

Preferably, the building system further comprises a base provided with a plurality of second connecting bars adapted to be inserted and tightened into the through holes of respective anchoring plates of the first portals of the first story of the building.

Each pillar can be provided at the lower end thereof with a plurality of notches which provide each an empty space, delimited at the bottom by the respective anchoring plate.

Moreover, each first connecting bar can have the longitudinal axis in common with the axis of a respective through hole of the anchoring plate.

Each beam is preferably provided with at least one recess and each connecting beam is provided with at least one projection adapted to wedge into a respective recess or vice versa, meaning that each beam is provided with at least one projection and each connecting beam is provided with at least one recess.

The first and the second connecting beams can be threaded, preferably at least partially threaded, and said clamping means for clamping said first and second connecting bars with the relevant anchoring plates can be bolts.

The floor panels are preferably provided with at least four notches.

Furthermore, additional armors can be provided, adapted to provide a constraint between two floor panels and/or between a portal and a floor panel and/or between a portal and a connecting beam adjacent thereto.

The portals are preferably provided with a projecting portion, located above the beam at each pillar, in the space delimited by the first connecting bars. The projecting portion can be integral with the pillar or be a separate piece, and it can be tapered upwards.

One aspect of the present invention provides a process for building a multi-story building using the system of claim 1 which, according to claim 10, comprises the following steps:

a) providing a plurality of first portals to construct a first story of the building, which are arranged along at least two mutually parallel vertical planes;

b) fixing first connecting beams between a first portal and the next first portal arranged along a same vertical plane of said at least two vertical planes;

c) transversely connecting together, by means of floor panels both the first portals arranged along the at least two vertical planes, and and the first connecting beams arranged along the at least two vertical planes;

d) clamping, using clamping means, anchoring plates of second portals for making a second story of the building immediately above the first story, to respective first connecting bars of the first portals;

e) fixing second connecting beams between a second portal and the next second portal arranged along a same vertical plane of said at least two vertical planes;

f) transversely connecting together, by means of floor panels both the second portals arranged along the at least two vertical planes, and the second connecting beams arranged along the at least two vertical planes;

g) repeating steps d)-f) to obtain a predetermined number of stories of the building.

Wet connections are preferably made after step d), even more preferably simultaneously with steps e), f).

The building system according to the invention is a prefabrication system, i.e. a system which makes use of prefabricated components, preferably of standard or precompressed reinforced concrete, used in a large number of projects of residential and non-residential buildings, with a high speed of execution.

It is substantially a system of the so-called "frame" type, i.e. consisting of mutually integrated prefabricated elements assembled with specific connections which ensure the structural integrity thereof at the end of the assembly process, with the particularity that the fundamental element is a portal, or portico, consisting of two pillars and one beam, produced at a prefabrication factory and forming a single piece in the shape of a trilithon.

This specificity, combined with the features of the other structural and non-structural elements making up the system, identifies it as:

prefabrication system of the frame type, with concrete elements with high mechanical resistance;

prefabrication system with high quality on site connections;

quick on site mounting and completion prefabrication system (high performance).

The system of the invention is an open type system which enables the integration, if necessary, with other structural elements such as rigid stairwells, elevator shafts and possibly load-bearing panels, as well as the possibility to replace alveolar floor panels with other type of floor, such as floor plates or ribbed plates, when the project involves a lower static strength of the floors.

The possibilities of variation of the basic parameters of structural grids (e.g. the size of portal pillar sections, the wheelbase of the portal pillars, the lengths of the floor panels, etc.), together with the capacity of organizing technologies and production facilities of prefabrication factories make it a highly flexible system.

Advantageously, the features of the building system of the invention are such as to make it particularly suitable for use in the manufacture of a wide range of buildings such as: residential buildings; buildings for school education, such as kindergartens, primary schools, secondary schools, universities, colleges for students; health buildings, such as hospitals, nursing homes, hospices for the elderly, medical clinics; office buildings, both public and private; tourism buildings, such as hotels and motels; social security buildings, such as barracks and prisons; sports buildings, such as gymnasiums.

Advantageously, the building system of the invention can be used in any type of climate zone and in any kind of aseismic or seismic area.

Additional advantages of the invention include:

Reduction of costs due to:

production at the prefabrication factory, with consequent certain costs and manufacturing times, high-quality, production in an area protected from climate events, in which a large number of items is manufactured, with a significant increase in productivity;

production at the factory, with optimal use of materials, such as medium-high resistance concrete, making extensive use of pre-compressed steels;

very high speed assembly of structural elements, such as levels of about 350 $m^2$/day per assembly team, or such as levels of about 1,050 $m^2$/day per single project;

low material consumption index (in terms of $m^3$ of concrete/$m^2$ of structure);

reduction of geometrical production tolerances of the portal element, as a result of the use of highly mechanized formwork and appropriate centering systems;

minimized positioning tolerances of the armors;

reduction in the number of parts to produce, store and load on vehicles for transportation.

Design advantages:

high level of flexibility in drawing up the projects;

large number of building types which can be built and thereby higher adaptability of this system even to projects not designed with prefabricated solutions;

variability in the lengths of portals;

variability in the lengths of beams;

possibility of having large structural meshes (i.e., areas without pillars and without bearing walls);

variability of the resistant sections of portals, which is reflected on the number of building stories and on the structural mesh sizes (up to 7.20 m wheelbase of the columns in the direction of the longitudinal axis of the portals and 9.60 m in the direction of the transverse axis of the portals);

very high integration between portals and beams of the system of the invention and the other story structural elements;

Excellent integration between the system of the invention and the plants, e.g. rough holes.

High level of thermal insulation of the building boundaries achievable with different solutions, not affected by the need to simultaneously have load bearing walls structurally and thermally with a high insulation.

Minimized volumes of concrete castings at the construction sites in cold climates.

Use of infill solutions of the walls with non-structural prefabricated panels, and therefore with different finishing solutions and with the possibility of easy integration with the transparent surfaces.

Advantageously, a lower number of parts than traditional solutions is required, a better structural commitment is obtained and fewer raw materials are used.

Advantageously, the system of the invention comprises a plurality of portals, each formed substantially of two pillars and one beam, which form a single monolithic piece. The portals replace all of the pillars and part of the beams which are used in the prior art prefabricated systems. Such portals are preferably produced by monolithic casting of reinforced concrete.

In a particularly advantageous manner, due to the peculiar mechanical connections with which the system of the invention is provided, such as anchoring plates, connecting bars, clamping means and wedges, it is possible to fasten together the prefabricated elements, such as portals and connecting beams, avoiding the use of shoring before wet connections, such as connections made by non-shrinking mortars or concrete. In particular, the system is self-bearing in all its steps: no shoring is needed nor the use of formwork on site and superimposed stories can be built without waiting for the curing of the finishing casting. It is therefore a really industrialized and rapid execution system, without waiting times between one story and the next.

The invention can further provide for the following features, taken individually or in combination:

The size of the portals varies within a same work;

The pillars of the different portals are not all aligned with one another, considering said at least two vertical stories parallel to each other;

The structural mesh of the pillars can be of various shapes and it can also be non-rectangular and with large-sized sides;

The pillars have an entire prefabricated section, which can vary from story to story, as a function of the different stress.

Moreover, advantageously, substantially any type of floor can be accommodated, with the possibility of lighter elements, such as alveolar elements, of sizes not limited by the system.

Moreover, the beams of the peripheral portals can have an edged profile, so no edge formwork is required.

The dependent claims describe preferred embodiments of the invention.

BRIEF DESCRIPTION OF THE FIGURES

Further features and advantages of the invention will appear more clearly from the detailed description of preferred, but not exclusive, embodiments of a building system of the invention, shown by way of a non-limiting example with the aid of the accompanying drawings, in which.

The same reference numerals in the figures identify the same elements or components.

DETAILED DESCRIPTION OF A PREFERRED EMBODIMENT OF THE INVENTION

Figure 1:
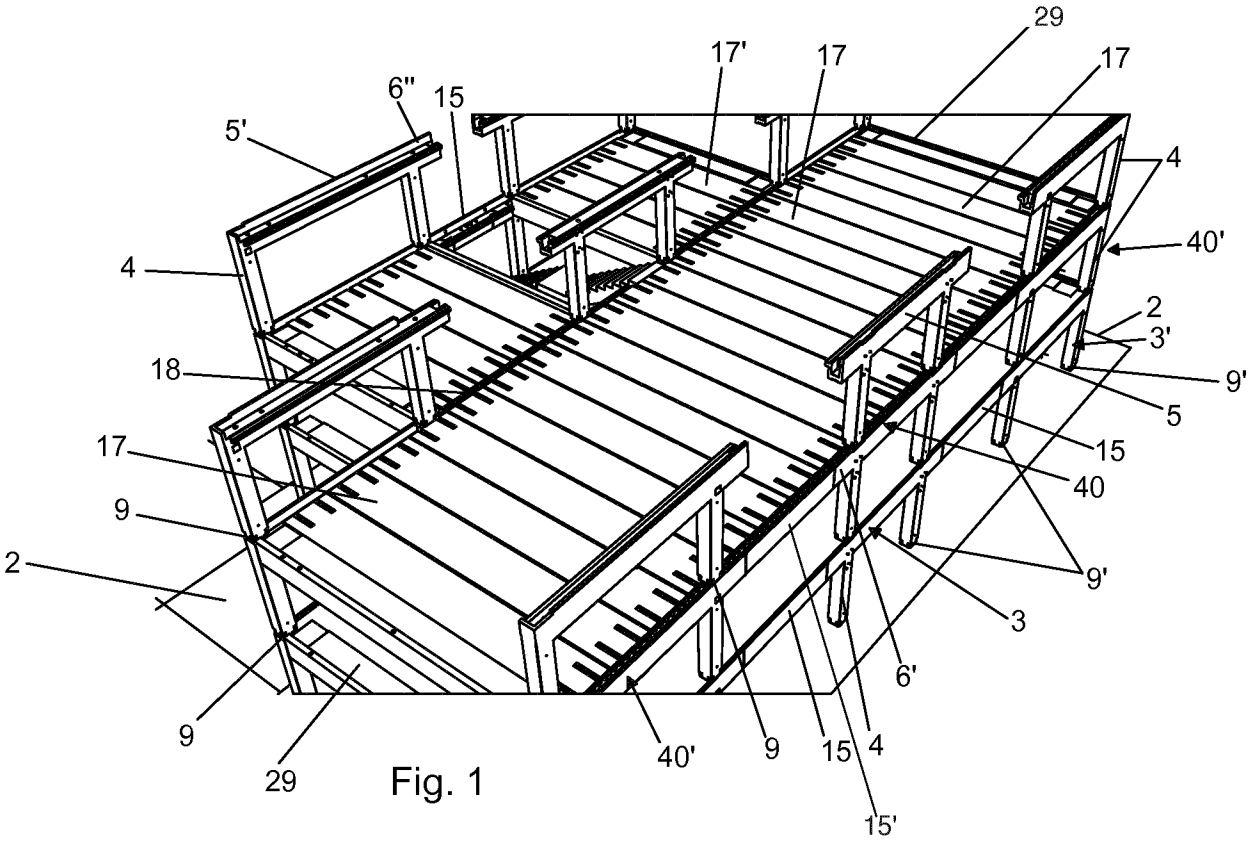
FIG. 1 shows part of a building built with the system according to the invention.
Figure 2B:
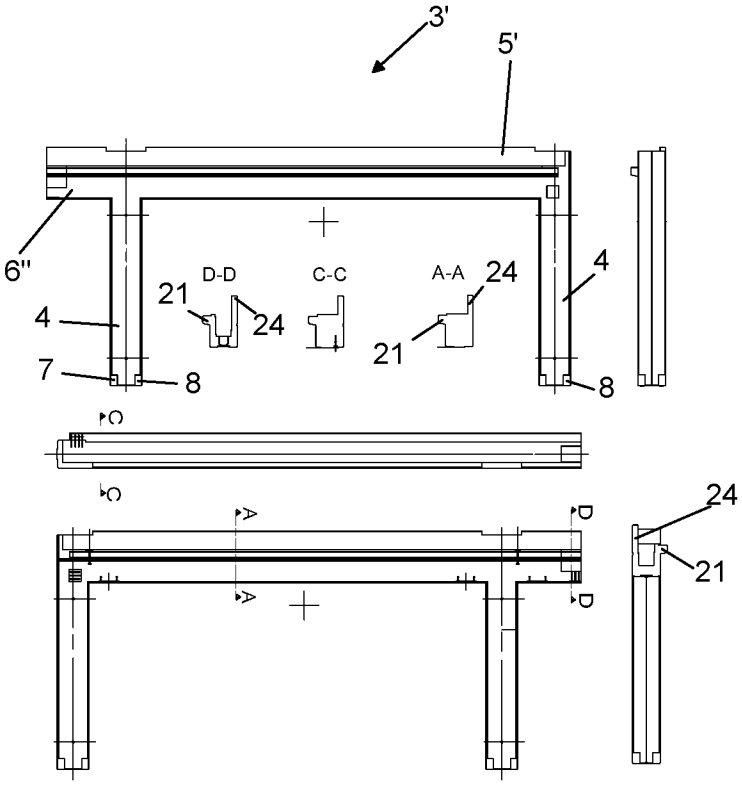
FIG. 2*b* shows a front view of a first, second, third side and fourth side, a top view and a first, second and third section of a further portal according to the invention.
Figure 2A:
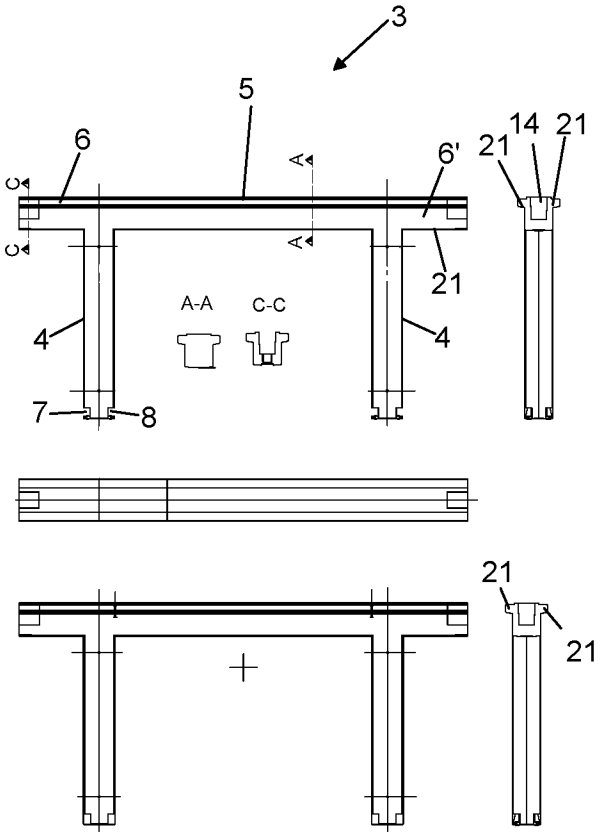
FIG. 2*a* shows a front view of a first, second, third side and fourth side, a top view and a first and second section of a portal according to the invention.
Figure 3:
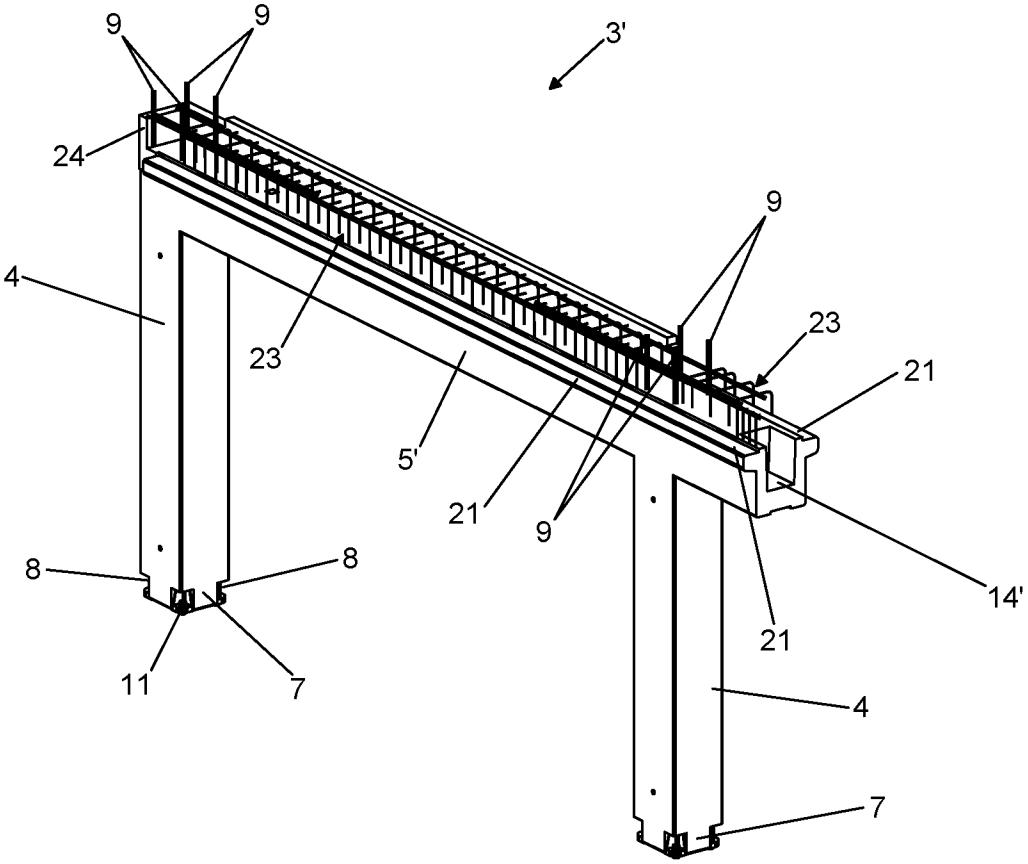
FIG. 3 shows an axonometric view of a portal according to FIG. 2*b;*

With reference to FIGS. 1 to 8, an embodiment of a building system for a multi-story building according to the invention is shown.

The system comprises a base 2 which is preferably prefabricated or can be made on site. Base 2 is provided with a plurality of threaded connecting bars 9' adapted to be attached to a plurality of portals 3, 3' which form the first story of the building. Each portal 3, 3' substantially consists of two pillars 4, arranged orthogonally with respect to base 2 and parallel to each other, and a beam of 5, 5', arranged transversely and completely on top of pillars 4. The two pillars 4 and beam 5, 5' of each portal 3, 3' form a single prefabricated monolithic piece, preferably but not exclusively made with a monolithic reinforced concrete cast. Preferably, portals 3, 3' are substantially flat, i.e. with a negligible size compared to the other two sizes. Portals 3, 3' according to the invention are substantially of two types but further types or sub-types are also possible. In particular, a first type of portal 3 is substantially shaped as a pi, π, i.e. beam 5 extends horizontally beyond each pillar 4. For the first type of portal 3, the portions of beam 5 which extend beyond pillars 4 are indicated with reference numerals 6, 6' respectively. In the second type of portal 3', beam 5' extends horizontally beyond a single pillar 4 only. For the second type of portal 3', the portion of beam which extends beyond pillar 4 is indicated with reference numeral 6". This second type of portal 3' is used at the sides of the building, arranging the part of portal 3' where beam 5' is not projecting beyond pillar 4 towards the periphery of the building. Preferably, portals 3 3' of each type, or sub-types if portal variants are used, are all equal to one another. Preferably, portals 3, 3' are all arranged parallel to each other, i.e. with beams 5, 5' arranged so that their greater length is oriented along the same direction and/or along directions parallel to such a direction.

Preferably, the first portals 3, 3', the first connecting beams 15 and the second portals 40, 40' portals are prefabs of concrete, which can be precompressed.

The height of each portal 3, 3' preferably corresponds to the height of one story of the building. Preferably, the height of each pillar 4 is equal to the distance between beam 5 of a first portal 3, 3' and beam 5' of a second portal 40, 40' when the second portal is placed on the first portal. According to the present embodiment, the cross section along a plane parallel to base 2 of pillars 4 is substantially quadrangular. The lower end 7 of each pillar 4 is provided with four angular notches 8 so that the cross section of each lower end 7 is substantially cross shaped. Beams 5, 5' are provided at each side of the upper portion thereof, along their entire greater length, with an edge 21. A variant of portals 3, 3' which are positioned at the periphery of the building is also provided, which are provided with a single edge 21 at one side of the upper portion thereof facing towards the inside of the building, and with a shoulder 24 extending upwards, arranged above a part of the upper portion of beam 5, 5' facing towards the periphery of the building. Each edge 21 preferably forms a step with the respective beam 5, 5'. Portals 3, 3' are preferably made of reinforced concrete, being provided with armors 23. The invention preferably provides for armors 23 to project upwards from beams 5, 5'. Moreover, four threaded longitudinal bars 9 are provided within each pillar 4, preferably at least partially threaded and preferably of steel, whose longitudinal extension is parallel to the longitudinal axis of pillars 4, and each bar 9 is placed at a distance from the longitudinal axis of pillar 4, so as to be at a respective notch 8 but without projecting downwards, i.e. without occupying the empty space created by each notch 8. Thereby, it is possible to easily work on the clamping means, as will be described hereinafter, in said empty space. Moreover, a terminal portion of each bar 9 extends externally above beam 5, 5', exceeding the height, with respect to base 2, of armor 23.

Moreover, a suitably shaped anchoring plate 11 is provided, fixed to the lower end 7 of each pillar 4 of a portal 3, 3', and provided with four through holes at notches 8. Due to the through holes, the connecting bars 9 of a portal 3, 3' can be inserted in the anchoring plate 11 of a portal 40, 40' of the building story above the story of portal 3, 3'.

Due to these features of portals 3, 3' and to suitable clamping means 13, such as bolts or clamping nuts, the portals 3, 3' of a building story can be mechanically fixed to the portals 40, 40' of the upper story with respect to the previous one, when they are aligned one above the other.

It is noted that respective through holes of the anchoring plate 11 are coaxial to respective connecting bars 9.

In a particularly preferred manner, by means of such a mechanical fixing, the lower ends of pillars 4 of a portal 40, 40' are spaced apart, leaving a space, from beam 5, 5' of a portal 3, 3' below it, so as to allow a further type of fastening, as will be better explained hereinafter.

The fixing of portals 3, 3', corresponding to the first story of the building, to base 2 is performed similarly. In fact, base 2 is provided with four threaded connecting bars 9', preferably at least partially threaded, at each pillar 4 of portal 3, 3', and it is connected through anchoring plate 11 of each pillar 4 of portal 3, 3' and clamping by clamping means 13, such as bolts, as described above.

The portions of beam 6, 6', 6" which extend beyond pillars 4 are shaped so as to provide wedge regions, such as recesses or projections. The portions of beam 6, 6', 6" which extend beyond pillars 4 are preferably shaped so as to have each a recess 14, 14', said portions of beam 6, 6', 6" having a substantially "U" shaped section.

Each story of a building which can be built with the building system of the invention comprises a plurality of portals arranged along at least two vertical planes parallel to each other.

The system of the invention further comprises a plurality of connecting beams 15 between one portal 3, 3' and the next arranged along a same vertical plane and belonging to the same story of the building. Each connecting beam 15 is provided, at the two ends thereof, with shaped portions so as to provide wedge regions, such as recesses or projections. Each connecting beam 15 is preferably provided, at the two ends thereof, with projections 16, 16' adapted to be wedged into recesses 14, 14' of portals 3, 3'. For example, a first projection 16 is wedged into the recess 14' of a first portal, and a second projection 16' is wedged into the recess 14 of a subsequent portal 3, arranged at the same height as the first portal from base 2, i.e. arranged in the same story of the building and arranged along the same direction. The connecting beams 15 are further provided with an edge 22 at each side of the upper portion thereof, along the entire greater length thereof with the exception of projections 16, 16'. A variant of the connecting beams 15 is also provided, which are positioned at the periphery of the building and are provided with an edge 22 only at one side of the upper portion thereof facing towards the inside of the building, and with a shoulder (not shown) extending upwards, arranged above a part of the upper portion of the connecting beam 15 facing towards the periphery of the building. Each edge 22 preferably forms a step with the upper portion of the connecting beam 15.

The connecting beams 15 are preferably made of reinforced concrete, being provided with an armor 23'. The invention preferably provides for armor 23' to project upwards from the connecting beams 15.

The system of the invention further comprises a plurality of floor panels 17, adapted to connect transversely two portals 3, 3' arranged along two different vertical planes parallel to each other, and belonging to the same story of the building. The floor panels 17 are also adapted to transversely connect two connecting beams 15 arranged along two separate vertical planes parallel to each other, and belonging to the same story of the building.

Each floor panel 17 has a substantially rectangular shape and is provided at each of two opposite ends, in particular the ends corresponding to the two shorter sides, with at least one pair of notches 18. Advantageously, each floor panel 17 is provided with four notches 18. Each floor panel 17 is preferably internally provided, along its longer length, with a plurality of cylindrical cavities 27 in order to decrease the overall weight thereof.

In the construction step, the floor panels 17 can be supported on beams 5, 5' and on the connecting beams 15, before being restrained. In particular, the floor panels 17 are supported between two portals 3, 3' arranged along two separate vertical planes parallel to each other, arranged one opposite the other, which belong to the same story of the building, being particularly supported on edges 21; moreover, the floor panels 17 are supported between two connecting beams 15 arranged along two vertical planes parallel to each other, arranged one opposite the other, which belong to the same story of the building, being particularly supported on edges 22.

The system of the invention preferably comprises transverse beams 29 (FIG. 8) for transversely connecting portals 3' of the peripheral sides of each story of the building and arranged on two parallel vertical planes. Mechanical and/or wet connections can be made between the transverse beams 29 and portals 3'. Each transverse beam 29 is preferably formed by two panels 30, 31 arranged orthogonally to each other, so as to have a substantially L shaped section.

Advantageously, in the construction step, it is possible to make a story comprising portals 3, 3', connecting beams 15 and floor panels 17 mechanically fixing them to one another, without the need for shoring. According to a particularly preferred embodiment, in a first construction step, portals 3, 3', the connecting beams 15 and the floor panels 17 are initially fixed together only mechanically. By mechanical connections it is meant wedging obtained by means of recesses 14, 14' and projections 16, 16', fastening by anchoring plate 11, threaded connecting bars 9, 9' and clamping by means of bolts 13, and use of additional armors 26, 26'.

Figure 4A:
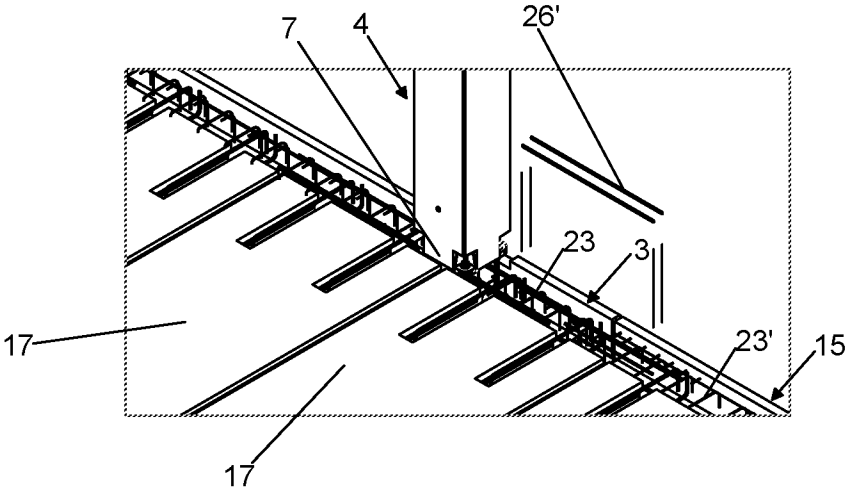
FIG. 4*a* shows a detail of connections according to the invention.
Figure 4B:
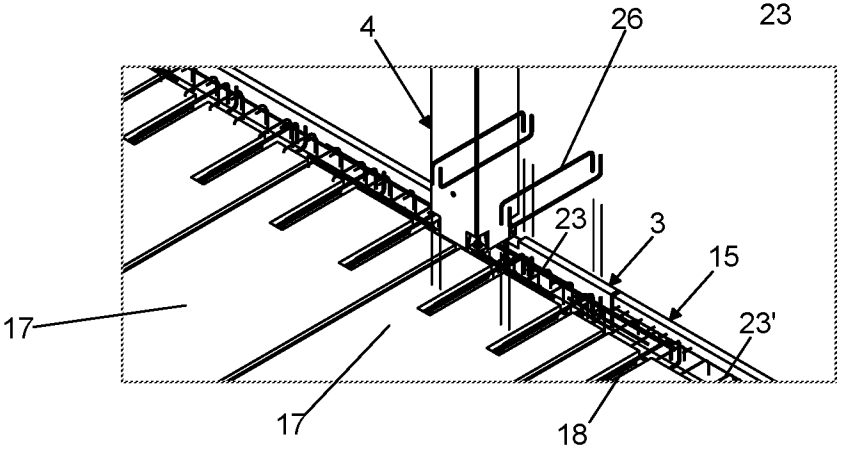
FIG. 4*b* shows a further detail of connections according to the invention.
Figure 4C:
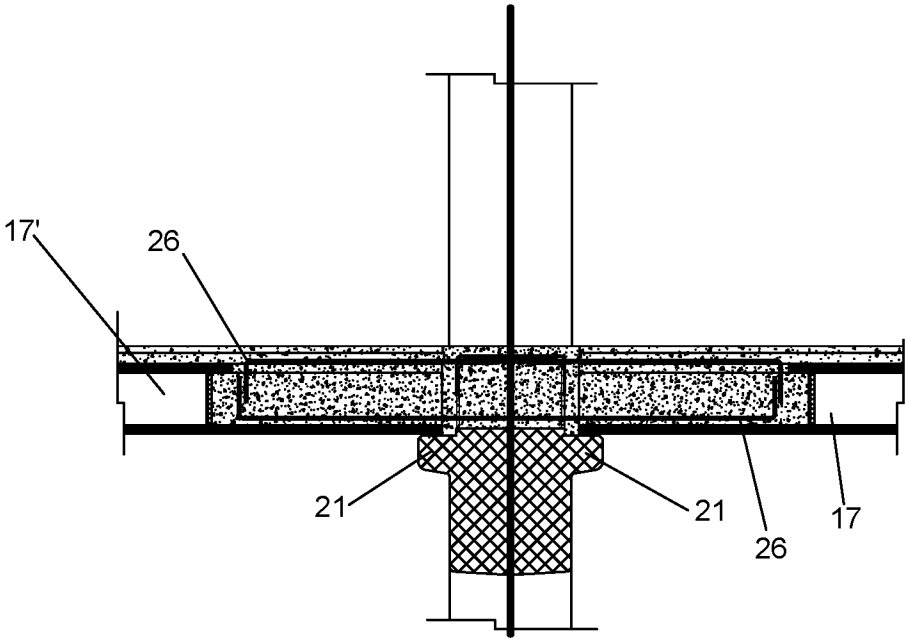
FIG. 4*c* shows a further detail of connections according to the invention.
Figure 5B:
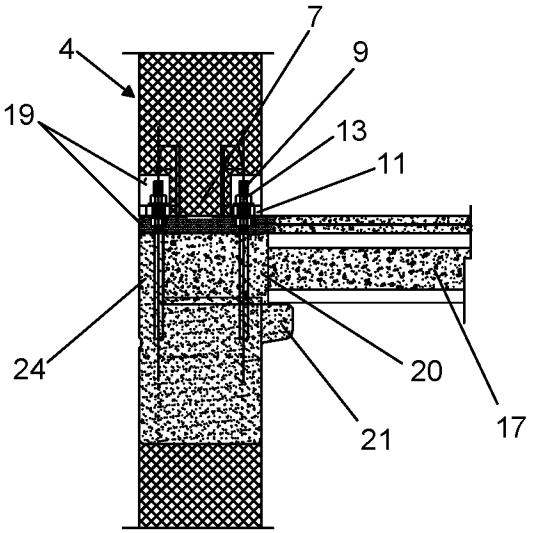
FIG. 5*b* shows a second vertical section of mutually fixed prefabricated elements of the system of the invention.
Figure 5A:
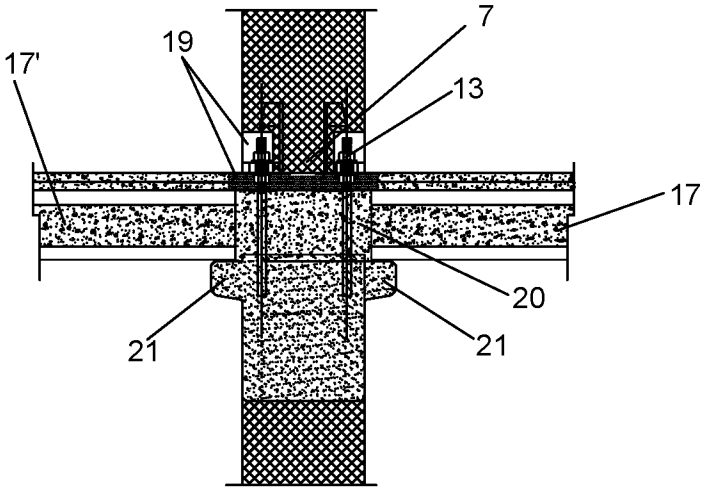
FIG. 5*a* shows a first vertical section of mutually fixed prefabricated elements of the system of the invention.
Figure 6:
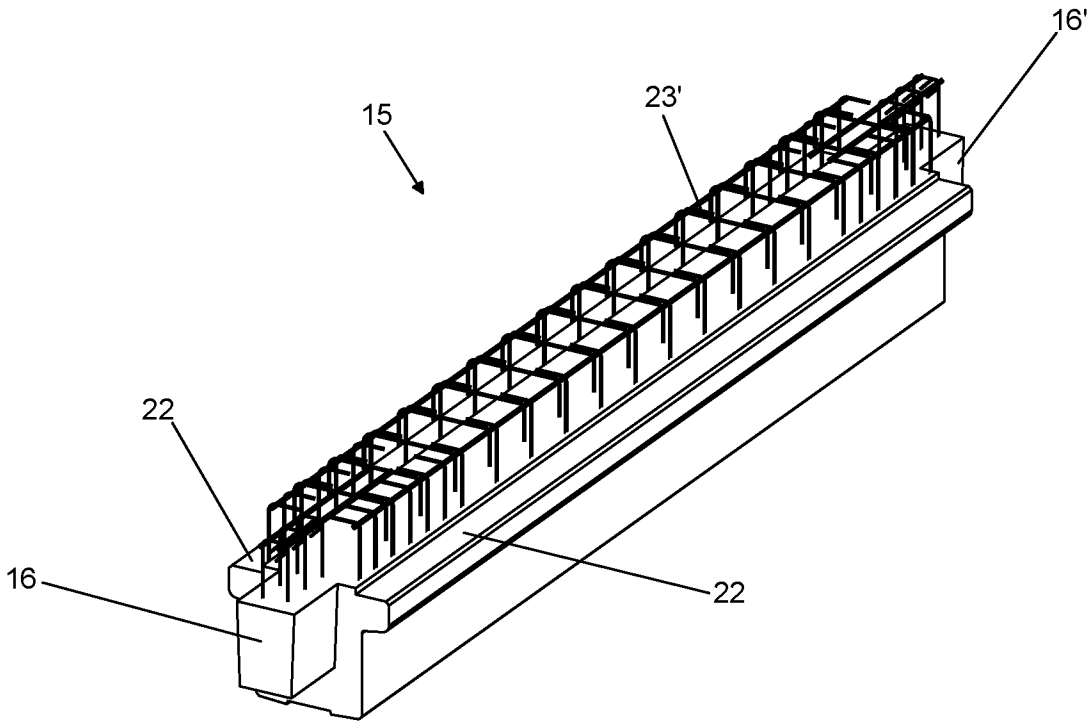
FIG. 6 shows an axonometric view of a connecting beam of the system according to the invention.
Figure 7B:
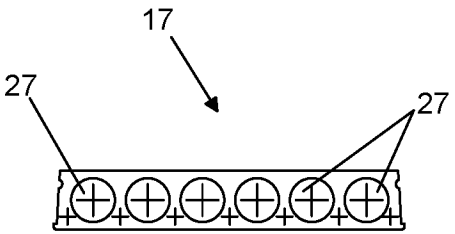
FIG. 7*b* shows a section of the floor panel in FIG. 7*a;*
Figure 7A:
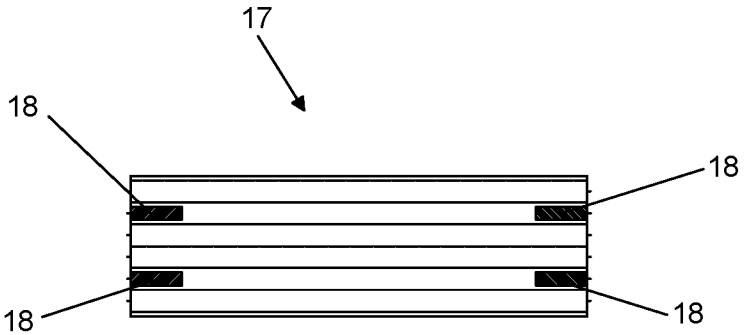
FIG. 7*a* shows a top view of a floor panel of the system according to the invention.
Figure 8:
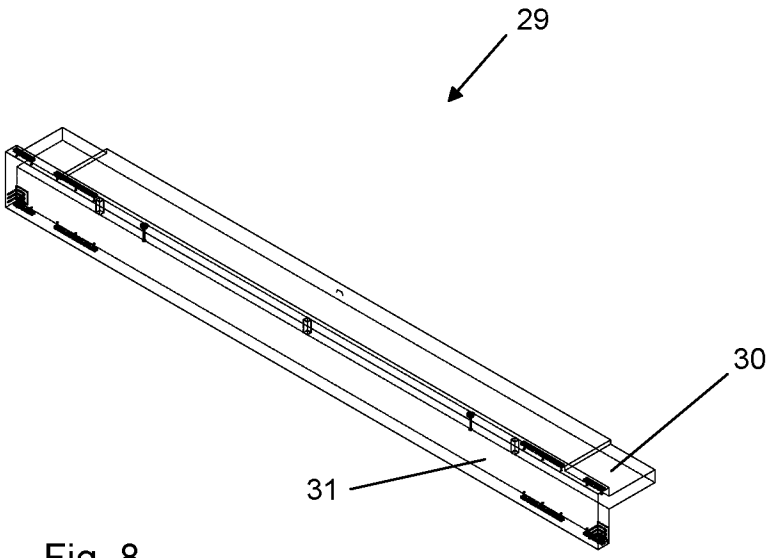
FIG. 8 shows an axonometric view of a transversal beam of the system according to the invention.

Subsequently to the mechanical connections, it is possible to make wet connections 19, 20 (FIG. 5), by way of a non-exclusive example, between the elements such as portals 3, 3', connecting beams 15 and floor panels 17. By wet connections it is meant, by way of a non-exclusive example, fixing using mortars 19 and/or concrete castings 20, in which additional armors 26, 26' can also be provided (FIG. 4).

The wet connections between the upper and lower portals are preferably made by means of anti-shrinkage mortars 19, with which the gaps between the anchoring plate 11 and pillars 4 are filled, including for example the gaps created by notches 8, and the gaps between the anchoring plate 11 and beams 5, 5' of the portals.

In a particularly advantageous manner, once the mechanical connections for one story of the building have been completed, it is possible to carry out the mechanical assembly of the elements of the upper story while making the wet connections of the lower story, thus reducing the building construction time.

The wet connections between beams 5, 5' of portal 3, 3', the connecting beams 15 and the floor panels 17 are preferably made by means of concrete casting 20, even more preferably by prior placement of additional armors 26, 26', providing a further type of mechanical fastening between elements of the system of the invention. Such additional armors are preferably shaped bars 26 in the shape of "U" and rods 26'. The shaped bars 26 are preferably used in pairs; each pair of shaped bars 26 is used to provide a restraint between a first floor panel 17 placed at a first side of a portal 3, 3', and a second floor panel 17' placed on the second side of portal 3, 3'. In the case of peripheral portals 3, 3', each pair of shaped bars 26 is constrained to armor 23 and to a floor panel 17. Connections, similar to those just described, are provided by means of the shaped bars 26 between the floor panels 17 and the connecting beams 15. In both cases, each pair of shaped bars 26 is preferably arranged in the space provided by each notch 18 of the floor panels 17. Each rod 26' is used instead to provide a restraint between a portal 3, 3' and the adjacent connecting beam 15. In particular, each rod 26' is fixed to the armor 23 of a portal 3 and to the armor 23' of the connecting beam 15 wedged thereto.

Figure 9B:
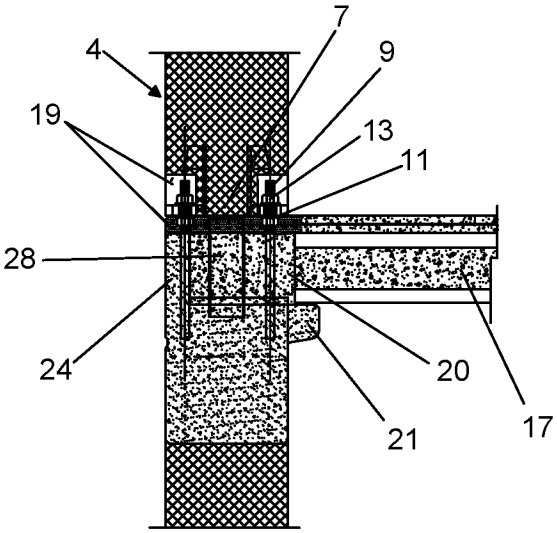
FIG. 9*b* shows a second vertical section of mutually fixed prefabricated elements of the system according to the variant in FIG. 9*a*.
Figure 9A:
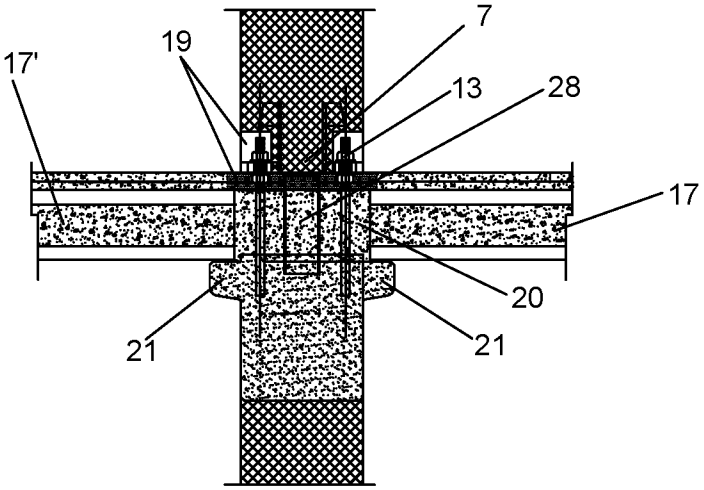
FIG. 9*a* shows a first vertical section of mutually fixed prefabricated elements of the system according to a variant of the invention.

With reference to FIGS. 9*a*, 9*b* according to an alternative variant, portals 3, 3', including the peripheral portals, are provided with a three-dimensional projecting portion 28 which can be tapered upwards, and in particular it can be frusto-conical, and is placed above beam 5, 5' at each pillar 4. Such a projecting portion 28, arranged in the space between the connecting bars 9 of each pillar 4, facilitates the support of an upper portal on a lower portal in the assembly step, so as to facilitate the fixing step of the connecting bars 9 to the anchoring plate 11. Moreover, the projecting portion 28 can be integrally formed with the pillar or be a separate piece.

In the case of peripheral portals 3, 3', such a projecting portion 28 has a greater height than shoulder 24.

The building system for buildings preferably comprises further elements, preferably prefabricated, such as stairs, provided in special stairwells, load-bearing bracing panels, fixtures, etc.

Preferably, the center distance between pillars 4 is from 3.6 m to 7.2 m.

According to one aspect of the present invention, a process is provided for building a multi-story building by means of the system of the invention, wherein there are provided the following steps:

a) providing a plurality of first portals 3, 3' to construct a first story of the building, which are arranged along at least two mutually parallel vertical planes;

b) fixing first connecting beams 15 between a first portal 3' and the next first portal 3 arranged along a same vertical plane of said at least two vertical planes;

c) transversely connecting together, by means of floor panels 17, both the first portals 3, 3' arranged along the at least two vertical planes, and the first connecting beams 15 arranged along the at least two vertical planes;

d) clamping, using clamping means 13, anchoring plates 11 of second portals 40, 40' for making a second story of the building immediately above the first story, to respective connecting bars 9 of the first portals 3, 3';

e) fixing second connecting beams 15' between a second portal 40' and the next second portal 40 arranged along a same vertical plane;

f) transversely connecting together, by means of floor panels 17, both the second portals 40, 40' arranged along the at least two vertical planes, and the second connecting beams 15' arranged along the at least two vertical planes;

g) repeating steps d)-f) to obtain a predetermined number of stories of the building.

As described above, in order to build the first story of the building, the anchoring plates 11 of the first portals are clamped by clamping means 13 to the respective connecting bars 9' of base 2.

As described above, in a particularly advantageous manner, after step d) and during the mechanical fixing operations provided by steps e) and f), the wet connections 19, 20 for the story of the building below can be carried out simultaneously.

According to a preferred embodiment, prior to the wet connections, the system elements are restrained to one another only by wedging obtained by means of recesses 14, 14' and projections 16, 16', by fastening the anchoring plate 11 and the threaded connecting bars 9, 9', and by clamping by means of bolts 13, and by using additional armors 26, 26'.

The invention claimed is:

1. A building system for buildings comprising at least two stories, wherein there are provided prefabricated reinforced concrete components, the building system comprising:

a plurality of first portals adapted to be arranged at least along two mutually parallel vertical planes and to be fixed to a base;

first connecting beams for connecting a first portal and the next first portal arranged along a same vertical plane of said at least two mutually parallel vertical planes;

floor panels adapted to transversely connect the first portals arranged along the at least two mutually parallel vertical planes and belonging to a same story of the building, and adapted to transversely connect the first connecting beams arranged along the at least two mutually parallel vertical planes and belonging to the same story of the building;

a plurality of second portals adapted to be arranged along said at least two mutually parallel vertical planes, each on top of a respective first portal;

second connecting beams for connecting a second portal and the next second portal arranged along a same vertical plane of said at least two mutually parallel vertical planes;

wherein the first portals, the first connecting beams, the second connecting beams and the second portals are prefabricated reinforced concrete components;

wherein each first portal and each second portal are monolithic and consist of at least two pillars parallel to each other and of a beam, arranged transversely and completely on top of the pillars, each pillar being provided with a plurality of first connecting bars, which are arranged inside each pillar, parallel to the longitudinal axis thereof, and extend outwards above the beam;

wherein a height of each pillar is equal to the distance between the beam of a first portal and the beam of a second portal, when the second portal is arranged on the first portal;

wherein each beam is provided with at least one recess, and each connecting beam of said first and second connecting beams is provided with at least one projection adapted to wedge into a respective recess;

wherein each beam is provided at each side of the upper portion thereof, along its entire greater length, with an edge;

wherein the first and second connecting beams are provided with an edge at each side of an upper portion thereof, along the entire greater length thereof with the exception of projections;

wherein portals adapted to be positioned at a periphery of the building are provided with a single edge at one side of the upper portion thereof facing towards the inside of the building, and with a shoulder extending upwards, arranged above a part of the upper portion of beam facing towards the periphery of the building;

wherein connecting beams of said first and second connecting beams adapted to be positioned at the periphery of the building are provided with an edge only at one side of the upper portion thereof facing towards the inside of the building, and with a shoulder extending upwards, arranged above a part of the upper portion of the connecting beam facing towards the periphery of the building;

whereby the floor panels between two portals can be supported on edges and the floor panels between two connecting beams are supported on edges;

wherein there is provided a plurality of anchoring plates, each anchoring plate being provided with through holes and constrained to a lower end of a respective pillar;

and wherein each pillar is provided at the lower end thereof with a plurality of notches which provide each an empty space, delimited at the bottom by the respective anchoring plate, whereby the first connecting bars of the first portals are adapted to be inserted into the through holes of the anchoring plates of the respective second portals and clamped in said empty space by clamping means.

2. The building system according to claim 1, wherein each pillar has the lower end provided with four angular notches so that the cross section of each lower end is cross-shaped.

3. The building system according to claim 1, further comprising a base provided with a plurality of second connecting bars adapted to be inserted and tightened into the through holes of respective anchoring plates of the first portals of the first story of the building.

4. The building system according to claim 1, wherein in each pillar each first connecting bar has the longitudinal axis in common with the axis of a respective through hole of the anchoring plate.

5. The building system according to claim 1, wherein said first and second connecting bars are threaded, and wherein said clamping means for fixing said first and second connecting bars with the respective anchoring plates are bolts.

6. The building system according to claim 1, wherein the floor panels are provided with at least two notches at each of two opposite ends.

7. The building system according to claim 1, wherein there are provided additional armors adapted to provide a constraint between two floor panels and/or between a portal and a floor panel and/or between a portal and a connecting beam adjacent thereto.

8. The building system according to claim 1, wherein the portals are provided with a projecting portion, placed above the beam, at each pillar, in the space delimited by the first connecting bars.

9. The building system according to claim 1, wherein said prefabricated reinforced concrete components are made of precompressed reinforced concrete.

10. A process of building a multi-story building by means of the building system according to claim 1, wherein there are provided the following steps:

a) providing a plurality of first portals to construct a first story of the building, which are arranged along at least two mutually parallel vertical planes;

b) fixing first connecting beams between a first portal and the next first portal arranged along a same vertical plane of said at least two mutually parallel vertical planes;

c) transversely connecting together, by means of floor panels, both the first portals arranged along the at least two mutually parallel vertical planes, and the first connecting beams arranged along the at least two mutually parallel vertical planes;

d) fixing, by means of clamping means, the anchoring plates of the second portals to respective first connecting bars of the first portals, for constructing a second story of the building immediately above the first story;

e) fixing second connecting beams between a second portal and the next second portal arranged along a same vertical plane of said at least two mutually parallel vertical planes;

f) transversely connecting together, by means of floor panels, both the second portals arranged along the at least two mutually parallel vertical planes, and the second connecting beams arranged along the at least two mutually parallel vertical planes;

g) repeating steps d)-f) to obtain a predetermined number of stories of the building.

11. The process according to claim 10, wherein after step d), wet connections are carried out.

12. The process according to claim 11, wherein the wet connections are carried out simultaneously with steps e), f).

* * * * *